United States Patent [19]

Stefano

[11] 4,103,891

[45] Aug. 1, 1978

[54] GAME DEVICES

[75] Inventor: Patrick L. Stefano, Cleveland, Ohio

[73] Assignee: Stanley M. Miska, Sr., Weston, Conn.

[21] Appl. No.: 765,598

[22] Filed: Feb. 4, 1977

[51] Int. Cl.[2] ..... A63B 67/10

[52] U.S. Cl. ..... 273/97 R; 273/98

[58] Field of Search ..... 273/95 R, 95 A, 97 R, 273/98, 100, 101, 105.2, 105.6, 109, 58 C, 85 C

[56] References Cited

U.S. PATENT DOCUMENTS

| | | | |
|---|---|---|---|
| 1,278,228 | 9/1918 | Schmidt | 273/97 R |
| 1,501,942 | 7/1924 | Carman | 273/100 |
| 1,827,383 | 10/1931 | Clark | 273/109 |
| 1,947,859 | 2/1934 | Lathers | 273/97 R |
| 2,312,423 | 3/1943 | Lathers | 273/98 |
| 2,784,971 | 3/1957 | Vogel et al. | 273/98 |
| 3,017,185 | 1/1962 | Marshall | 273/100 X |
| 3,596,908 | 8/1971 | Long et al. | 273/85 C |

*Primary Examiner*—William H. Grieb
*Attorney, Agent, or Firm*—William G. Rhines

[57] ABSTRACT

A game device which, in one embodiment comprises a playing surface in the form of a regular geometric shape made from strong, flexible, sheet-like material, having holes therethrough in the edge regions large enough to permit passage therethrough of a ball affixed to one end of a tether rope, the other end of which is affixed to said surface midway between said holes.

14 Claims, 7 Drawing Figures

GAME DEVICES

BACKGROUND OF THE INVENTION

In the field of game devices, it is known to have a rigid playing board supported on compressible supports, with holes in the board through which a ball may be made to pass provided a player correctly manipulates the board vis-a-vis his fellow players. In this connection reference is made to U.S. Pat. No. 1,827,383. However, enjoyment with such devices is limited by such things as the rigidity of the board, the relative difficulties of housing, storing and transporting them, and their substantial restriction to indoor use.

Accordingly, it is an object of this invention to provide game means for competitive games involving a motion responsive object, which overcomes or minimizes prior art objections.

SUMMARY OF THE INVENTION

In accordance with the present invention, there is provided a sheet-like surface made from flexible material, and a tether, one end of which is affixed to the mid-region of said surface, to the other end of which is affixed a playing object, said surface having at least two holes therein which, in one embodiment, are at least as large as said object and are positioned in the edge region of said surface and are substantially eqidistant from the point of affixation of said tether to said surface at a distance therefrom not substantially greater than the length of said tether, and the angular displacement of which with respect to each other is substantially $360°/n$ where "$n$" is the number of said holes. Other embodiments may include holes smaller than the object, so that the object is not free to fall through any of the holes, but merely comes to rest therein. Still other embodiments may include groups of two or more holes each, wherein the midpoints between the holes comprising each of said groups, with respect to the midpoints of the other to said groups next adjacent, are at an angular displacement of substantially $360°/n$ where "$n$" is the number of said holes.

In other embodiments of this invention, the peripheral edge of said surface comprises at least "$n$" substantially straight sections, each one of which is substantially bisected by and perpendicular to an imaginary line extending from said point of affixation through the center of each of said holes, or, in the case of embodiments comprising groups of holes, through each midpoint between the holes in each such group.

Other embodiments include arcuate peripheral edges similarly positioned with respect to the holes, as well as straight or arcuate peripheral edges, the ends of which abutt substantially at their points of intersection with imaginary lines extending from said point of affixation through the center of each of said holes or, in the case of embodiments comprising groups of holes, through each midpoint between the holes in each such group.

Additionally embodiments may include decorative effects which enhance playing one or more games using such devices.

DESCRIPTION OF DRAWINGS

This invention may be understood from the description set forth herein and from the annexed drawings in which.

DESCRIPTION OF THE PREFERRED EMBODIMENTS

Figure 1:
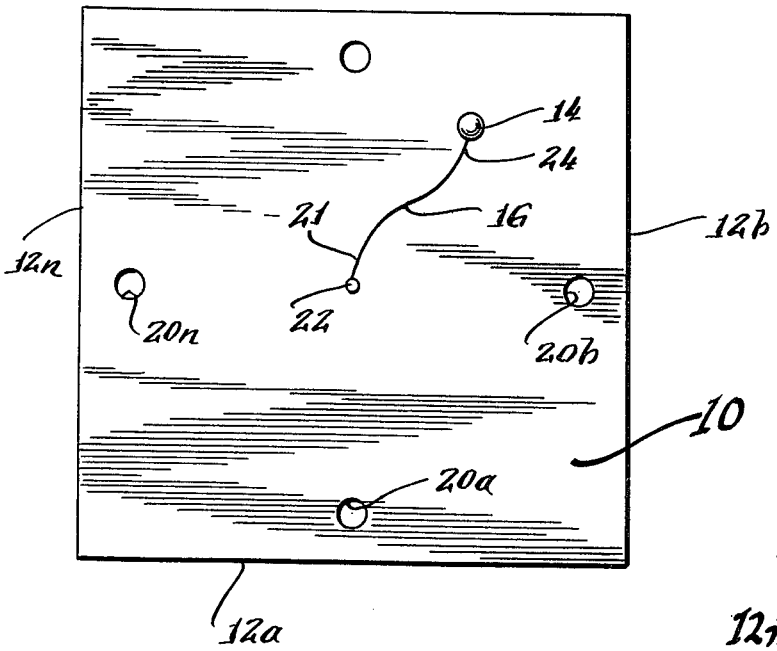
FIG. 1 depicts an embodiment of the present invention.

Referring first to FIG. 1, there is depicted an embodiment of the present invention comprising a playing surfact 10 made from strong, flexible, sheetlike material, such as B.F. Goodrich's "Naugahyde" plastic sheet, laminated to a reinforcing scrim, or the like, preferably washable, non-fraying, durable, abrasion and scuff resistant, and with a suitable playing surface. It will be apparent from what follows that supple flexibility combined with good tensile strength and durability are desirable in order to enhance the enjoyment in the use of such devices. The device illustrated in FIG. 1 happens to be a square, but it will be apparent that virtually any geometric shape falls within the contemplation of this invention, although "regular" geometric shapes (i.e., ones affording equal playing conditions to all participating players) such as squares, equilateral triangles, hexagons, sexagons, septagons, octagons, etc. may be preferred.

Figure 2A:
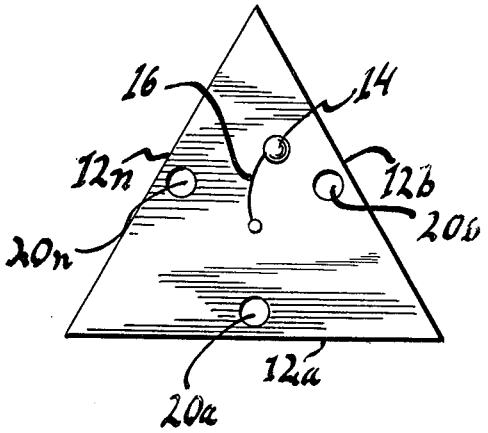
FIG. 2*a* depicts another embodiment of the present invention.
Figure 2B:
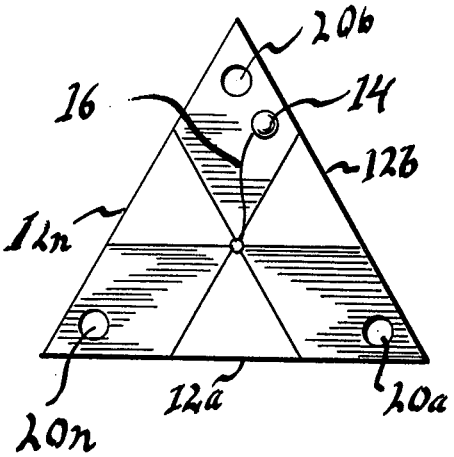
FIG. 2*b* depicts another embodiment of the present invention.
Figure 2C:
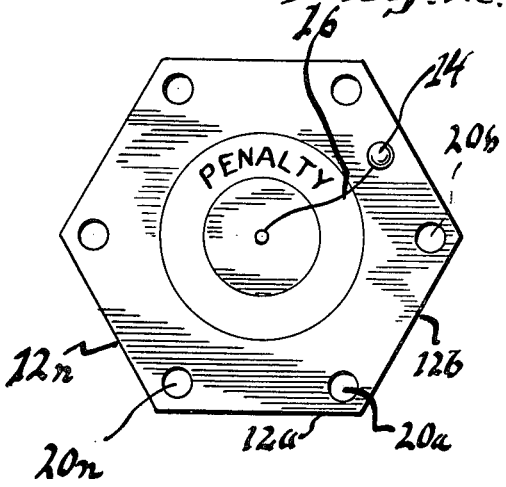
FIG. 2*c* depicts another embodiment of the present invention.

Positioned about the "edge regions" of the playing surface (i.e. between the actual peripheral edges 12*a*, 12*b*, . . . 12*n* of the playing surface and inside the location of the object 14 when its associated tether 16 is fully extended and swung through 360° to described a circle), are holes 20*a*, 20*b*, . . . 20*n*, each of which may be made at least as large as is the object 14, so that the object may pass through it, or somewhat smaller than the object so that it may merely lodge in the hole without passing through it. As shown in FIG. 1, there are four such holes, since this number accomodates well to the square playing surface illustrated, making this particular configuration especially suitable for play by two or four players. Of course, if it is desired to have a device with which multiples of three can play, an equal number of multiples of three such holes should be used, and the peripheral geometry of the playing surface might be altered to accomodate it to such uses by using shapes which are corresponding multiples (e.g., triangles. hexagons, etc.). Similarly, multiples of four might advantageously be accomodated by square, octagonal, etc. shapes. Some of the shape variants falling within the contemplation of the present invention, and some of the surface marking variants which may be utilized with embodiments of this invention, are shown in FIGS. 2*a*, 2*b*, and 2*c*. Normally, it is desirable to space the positioning of the holes uniformly in angular displacement about the playing surface, so as to give each participating player substantially the same amount of "territory" to control. Such dispositions may be expressed by the formula $$A = 360°/n$$

where $n$ = number of holes and $A$ = angular displacement between holes.

Thus:

for a 3-hole game; $A = 360°/3 = 120°$ for a 4-hole game; $A = 360°/4 = 90°$ for a 6-hole game; $A = 360°/6 = 60°$ and for a 8-hole game; $A = 360°/8 = 45°$, etc.

Affixed to the center region (i.e., the area about halfway between opposite peripheral edges of the playing surface) is one end 21 of a tether 16, which advantageously may be in the form of a supple cord or rope connected to the playing surface by means of a knot or other affixation means 22.

Affixed to the other end 24 of the tether 16 is an object, preferably such as a ball or other spheroid, which will move freely by rolling in response to gravity, urging, or other applied forces, but of course it might be desirable to introduce an additional element of chance into game played with such devices by having the object in the form of such things as an ellipsoid or other moveable irregular object. Optionally, objects used with this invention may be solid or hollow, or partially or totally liquid filled to impart weight, irregular motion, or other desired effects.

Figure 3A:
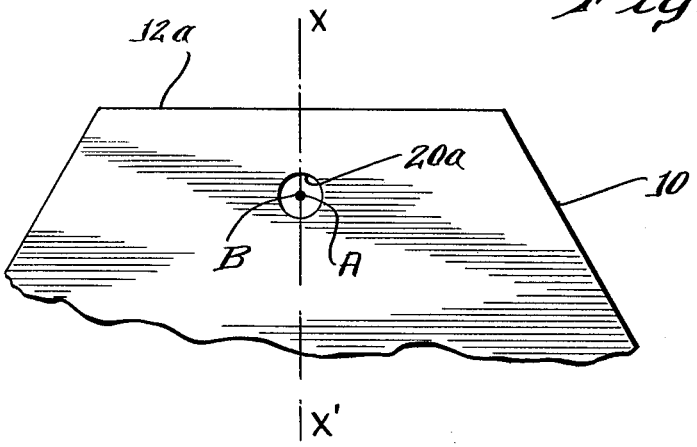
FIG. 3*a* depicts another embodiment of the present invention.
Figure 3B:
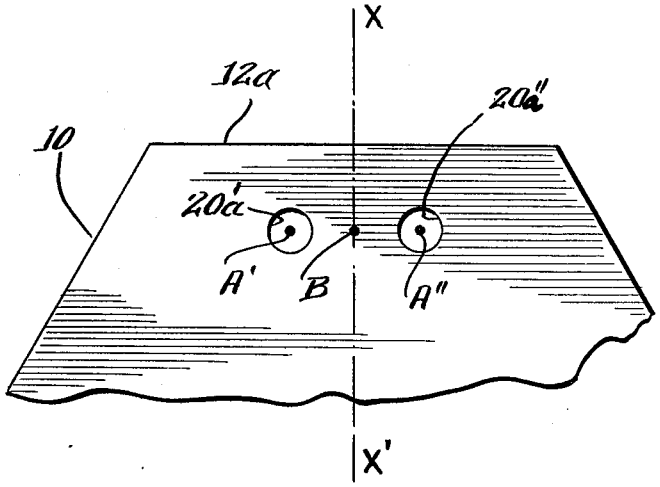
FIG. 3*b* depicts another embodiment of the present invention.
Figure 3C:
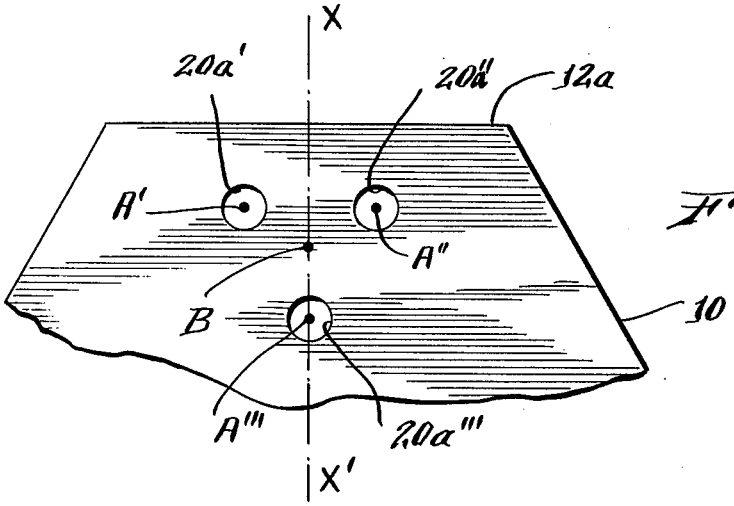
FIG. 3*c* depicts another embodiment of the present invention.

FIGS. 3*a*, 3*b*, and 3*c*, illustrate other embodiments of the present invention. As shown in FIG. 3*a*, as in the embodiments previously described, a single hole 20*a*, through the playing surface 10, is associated with one edge 12*a*. In such embodiments of this invention, where each object receiver area of the playing surface comprises a single hole, the mid-point "B", of the area is also the center "A" of the hole 20*a*, and an imaginary straight line X'—X from the center (not shown) of the playing surface 10 will pass through both points simultaneously. In FIG. 3*b*, there is depicted an embodiment wherein two holes 20*a'* and 20*a''* are associated with an edge 12*a*, the centers A', A'' of which are substantially equidistant from the mid-point B between them on the imaginary straight line X'—X extending from the center to the peripheral edge 12*a* of the playing surface 10. In this sense, the mid-point B is analagous to the center A of the single hole embodiments of the present invention previously illustrated.

In FIG. 3*c*, an embodiment having three holes 20*a'*, 20*a''*, 20*a'''* adjacent the edge 12*a* of playing surface 10, positioned in equilateral triangular configuration with respect to each other. The mid-point B, equidistant from the centers A', A'', A'' respectively of each of these holes and on the imaginary straight line X'—X passing from the center (not shown) of the playing surface 10 through the lateral edge 12*a*.

From the foregoing, it will be apparent that it is advantageous in describing this invention to refer to the "mid-point" of "object receiver areas" (i.e., areas, the periphery of each of which is described by the single hole alone, or group of holes collectively, comprising it) rather than simply to the position of the center points of holes, per se, since this form of designation facilitates description of not only embodiments having a single hole per playing "station", but also ones wherein there is more than one hole per playing station.

Games which may be played with devices in accordance with this invention include the following. Each player positions himself facing an edge of the playing surface opposite one of the holes, and, with the object 14 placed at or near the tether affixation means 22, the players each grasp an edge of the surface in front of him and together they all lift the surface to a pre-agreed level with the surface stretched as near to flat as possible. Upon a signal the players try, by moving the surface up and down, wrinkling the surface, snapping it up in the air to make the object hop from place to place (e.g., over "penalty areas"), even using it to try to pull one another off their feet, tries to get the object into "his" hole (i.e., the one in front of him), or perhaps into that of one of the other players, according to the expressed object of the game. Of course, wide variants in the objectives of the game and the applicable rules may be utilized to render a game enjoyable to the participants.

It will also be apparent that surface decorations, figures, legends, etc., may be used to enhance enjoyment of the chosen games, such as score numbers, penalty areas, etc. A few such are shown on the various FIGS. 2*a*, 2*b* and 2*c* which show some of the configurations into which embodiments of this invention may be rendered.

It is to be understood that the embodiments of this invention herein depicted and discussed are by way of illustration and not of limitation, and that a wide variety of other embodiments may be made without departing from the spirit or scope of this invention.

I claim:

1. A game device comprising a sheet-like playing surface made from supple, wrinklable, snappable, flexible material, for being grasped for manipulation by at least two players, and a tether, one end of which is affixed to the mid-region of said surface, and to the other end of which is affixed a playing object, said surface having at least two object receiver areas positioned in the edge region of said surface with their respective mid-points substantially equidistant from the point of affixation of said tether to said surface, each of which areas comprises one or more holes in said surface into which said object will fit, the outermost of which holes have their centers at a distance from said point not greater than the length of said tether plus the distance from the center of said object to its point of affixation to said tether, the angular displacement of the mid-points of said areas with respect to each other being substantially $360°/n$ where "$n$" is the number of said areas, whereby players grasping edges of said surface may manipulate said surface to cause relative motion between said playing object and one or more of said holes.

2. The device described in claim 1 wherein each of said receiver areas comprises one hole, the center of which is located substantially at the mid-point of the receiver area with which it is associated.

3. The device described in claim 1 wherein each of said receiver areas comprises a group of two or more holes, the centers of which are substantially equidistant from the mid-point of the receiver area with which they are associated.

4. The device described in claim 1 wherein the peripheral edge of said surface comprises at least "$n$" substantially straight sections, one of which is substantially bisected by and perpendicular to an imaginary line extending from said point of affixation through the mid-point of each of said areas.

5. The device described in claim 2 wherein the peripheral edge of said surface comprises at least "$n$" substantially straight sections, one of which is substantially bisected by and perpendicular to an imaginary line extending from said point of affixation through the mid-point of each of said areas.

6. The device described in claim 3 wherein the peripheral edge of said surface comprises at least "*n*" substantially straight sections, one of which is substantially bisected by and perpendicular to an imaginary line extending from said point of affixation through the mid-point of each of said areas.

7. The device described in claim 2 wherein said surface includes decorative effects which enhance playing one or more games to be played using said device.

8. The device described in claim 3 wherein said surface includes decorative effects which enhance playing one or more games to be played using said device.

9. The device described in claim 1 wherein said tether is rope-like and said object is a sphere.

10. The device described in claim 2 wherein said tether is rope-like and said object is a sphere.

11. The device described in claim 3 wherein said tether is rope-like and said object is a sphere.

12. The device described in claim 4 wherein said tether is rope-like and said object is a sphere.

13. The device described in claim 5 wherein said tether is rope-like and said object is a sphere.

14. The device described in claim 6 wherein said tether is rope-like and said object is a sphere.

* * * * *